US005408861A

United States Patent [19]

McCain et al.

[11] Patent Number: 5,408,861

[45] Date of Patent: Apr. 25, 1995

[54] DENT REMOVING PNEUMATIC PULLER

[76] Inventors: Paul R. McCain, 14355 Sundance Dr., Reno, Nev. 89511; Harold L. Hull, 401 Canyon Way #43, Sparks, Nev. 89434

[21] Appl. No.: 167,131

[22] Filed: Dec. 16, 1993

[51] Int. Cl.[6] ..... B21D 1/12

[52] U.S. Cl. ..... 72/457; 72/705

[58] Field of Search ..... 72/457, 705

[56] References Cited

U.S. PATENT DOCUMENTS

| | | | |
|---|---|---|---|
| D. 314,126 | 1/1991 | Moore | D8/67 |
| 3,635,072 | 1/1972 | Steinmann, Jr. | 72/457 |
| 4,050,271 | 9/1977 | Jones | 72/705 |
| 4,072,042 | 2/1978 | Servin et al. | 72/457 |
| 4,073,181 | 2/1978 | Steinmann, Jr. | 72/479 |
| 4,495,791 | 1/1985 | Kemnitz et al. | 72/453.02 |
| 4,653,167 | 3/1987 | Mullins | 72/705 |
| 4,924,056 | 5/1990 | Bevilacqua | 219/98 |
| 5,329,802 | 7/1994 | Nunez | 72/705 |

*Primary Examiner*—Lowell A. Larson

[57] ABSTRACT

Disclosed herein is a dent puller attachment tool for repair of dented sheet metal. The tool provides on one end an assembly for engagemnt with a removable self tapping member. While on its opposite end is a recess adapted for communication with an air wrench drive and in a second embodiment includes a unique drill and screw combination bit.

4 Claims, 2 Drawing Sheets

FIG 3
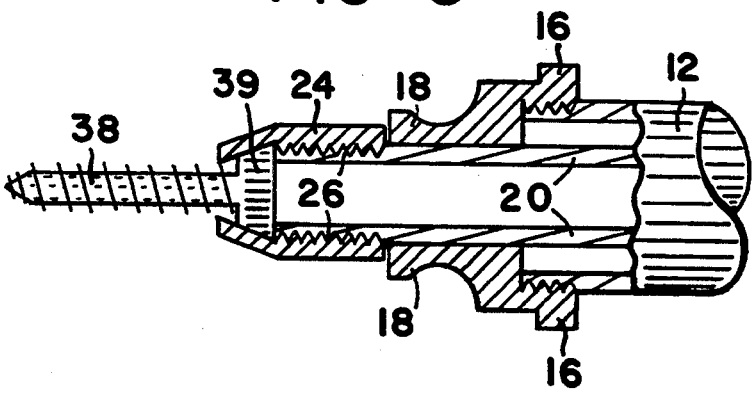
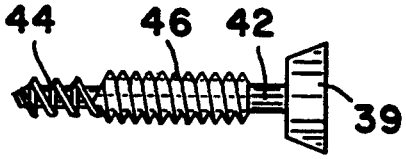
FIG 4
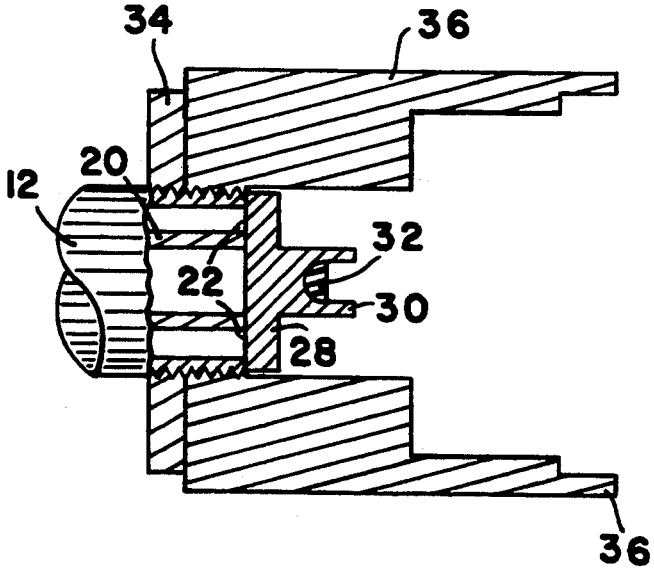
FIG 5

DENT REMOVING PNEUMATIC PULLER

FIELD OF THE INVENTION

This invention relates to dent pullers in general but more particularly to a dent puller which is actuated by air and cooperates with a prior art air wrench.

BACKGROUND OF THE INVENTION

In the past, a number of attempts have been made to provide means to remove dents from automobile bodies. For many years workman have used a traditional tool known as a slap hammer which includes a pointed tip used for engagement with the body panel, usually by screwing it into a hole which has been previously drilled. Thereafter, a weight which is slidable upon a shaft connected to the point is used to hammer the weight outwardly to pull the fender back into shape. U.S. Pat. No. 4,924,056 teaches a slap hammer which includes a stud welding gun to releasably grip a stud and weld it to the dent and an integral hammer means which applies force to the stud and straightens the dent.

Another example is U.S. Pat. No. 4,495,791 which discloses a pneumatic puller having a threaded point and includes a piston for driving force against a rear cap by pressure of compressed gas and a spring is used to return the piston within the tool.

U.S. Pat. No. 4,072,042 provides a pneumatic puller which includes a universal joint which allows the apparatus to cooperate with a pneumatic wrench and a harness is used to prevent the output shaft from disengagement from the universal joint.

These and other prior art references are complete and functional for their intended use, however, each have inherent drawbacks which the present invention addresses. Such as the use of external drive which can be dangerous for the workman and the need of a piston and/or a universal joint. Also, the present invention eliminates impact to the shaft on the driver, unlike the prior art.

The prior art of reference necessitates the need to drill a hole and then screw the tip of the slap hammer into the workpeice, whereby, the need of an additional tool, such as a drill, is required. The present invention eliminates this need, in one embodiment, as we provide a unique bit, which includes "both" drill flutes and screw threads.

SUMMARY OF THE INVENTION

It is therefor a primary object of the present invention to provide a slap hammer apparatus which includes internal drive means and therefore is much safer to use.

A further object, is to provide a slap hammer which eliminates the need of a U-joint.

Still a further object is to provide a slap hammer which eliminates any undue stress on the shaft of the driver.

Yet another object is to provide a slap hammer which cooperates with a pneumatic wrench.

It is still a further object to provide a slap hammer which eliminates the need of a piston.

Still another very important object is to provide a slap hammer which accepts and cooperates with a unique bit which includes both drill flutes and screw threads.

Further objects and advantages will become apparent when taken into consideration with the following drawings and specifications.

BRIEF DESCRIPTION OF THE DRAWINGS

FIG. 3, is a partial sectional view taken at 3—3 of FIG. 1.

FIG. 4, is a side view of our unique bit which includes drill flutes and screw threads combined.

FIG. 5, is a sectional view taken at 5—5 of FIG. 2.

DETAILED DESCRIPTION OF THE DRAWINGS

Figures 1, 2:
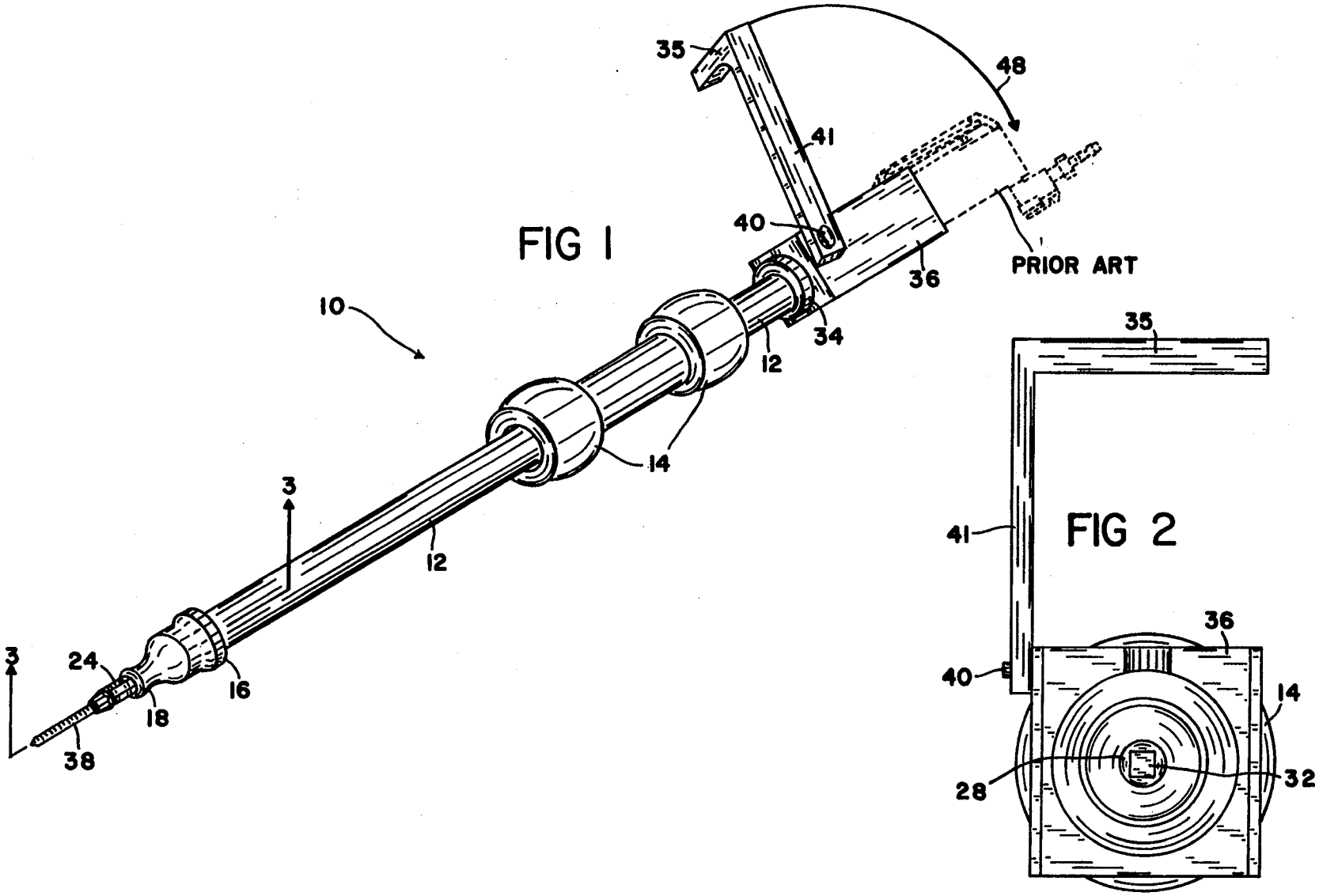
FIG. 1, is a perspective view of the slap hammer when attached to a prior art air wrench (the wrench shown in ghost lines).
FIG. 2, is an end view of the slap hammer which shows mating means for attachment with a prior art air wrench.

Referring now in detail to the drawings, wherein like characters refer to like elements throughout the various drawings, the dent removing pneumatic puller tool, generally indicated by reference numeral 10, comprises substantially an elongated hollow shaft 12 having an outside perimeter which can be circular, square, rectangular, etc. and which has a first and second threaded end. Mounted on shaft 12, is a weight 14, substantially in the shape of a dumbbell and includes an axial base through which shaft 12 can extend, whereby, providing shaft 12 with a slidable relationship within weight 14. 16 is a stop having a first end and is threadably engaged with the first end of shaft 12, stop 16 also includes a projection 18.

20 is a rod which may be hollow, has first and second ends and includes threads 26 on its first end. Rod 20 has an outside perimeter which may be circular, square, rectangular, etc. and is of a sufficient length to extend longitudinally through shaft 12, stop 16 and into threaded nose cone 24, as shown by FIG. 3. Nose cone 24 has a first end which is threadably engaged with the first end of rod 20. Nose cone 24 having a second end which is of an internally tapered configuration to capture and secure a self tapping threaded member 38 which is an integral part of tapered screw head 39 when engaged on rod 20. The second end of rod 20 is fixidly attached to the first end of an abutment member 28 by means such as welding 22, or the like, (as shown in FIG. 5) with member 28 having a perimeter less than the perimeter of shaft 12. Member 28 includes a recess 30 substantially on its second end. Recess 30 may provide a space for a shock absorbing insert 32 which absorbs shock and is fixidly attached by means such as glue or the like, (not shown). Recess 30 and shock absorbing insert 32 are of a shape and size to accept engagement with a forward and reverse drive on a typical pneumatic air wrench, such as produced by CHICAGO PNEUMATIC, type CP-720 (shown in ghost lines).

The second end of shaft 12 is threadably engaged with a jam nut 34 and a housing 36. Housing 36 is substantially elongated with its inside surface area being of a shape and size to accept and mate with a typical pneumatic wrench. Housing 36 also includes on one of its sides, pivotable means, such as by screw 40 and a nut (not shown) to attach to the long leg 41 of an L-shaped locking member 35. L-shaped locking member 35 includes a first unlocked position and a second locked position as shown by arrow 48, whereby, when the puller tool is engaged with a typical air wrench and L-shaped member 35 is positioned in its locked position, the wrench is thereby secured to the tool.

In FIG. 4, we show a unique design for a bit 42 which includes drill flutes 44 and screw threads 46.

In use, a typical air wrench (as shown in ghost lines) is positioned within housing 36, whereby causing abutment member 28 and shock absorbing insert 32 to mate with the drive (not shown) of the air wrench. The air wrench and tool are then fixidly attached by L-shaped member 35 when placed in its locked position.

Actuation of the air wrench provides a forward rotating force which causes the shock abosorbing insert 32, recess 30, abutment member 28, rod 20, nose cone 24, and screw head 39 which is an integral part of self tapping member 38, to rotate in a forward direction, whereby causing self tapping member 38 when positioned upon the workpeice (not shown) which is to be straightened, to rotate and threadably engage into a hole (not shown) which has been previously drilled. Or as in our preferred embodiment, the combination drill and screw 42 is threadably engaged within the workpeice (not shown) which is to be straightened. The self tapping member 38 or the combination drill and screw 42 are threadably engaged into the workpeice until nose cone 24 is pressed flush against the workpeice.

Thereafter, weight 14 is gently positioned against stop member 16 and then violently pulled back against jam nut 34, thereby causing enough force to pull the workpeice back into its desired shape.

Actuation of the air wrench when in its reversed mode, removes self tapping member 38 or the combination drill and screw 42.

It will now be seen that we have provided a dent removing pneumatic puller which includes internal drive means and is therefore much safer to use.

It will further be seen that we have provided a dent puller which eliminates the need of a U-joint, a piston and reduces strain on the shaft of the drive.

It will also be seen that we have provided a dent puller which cooperates with a typical air wrench and a unique bit which includes drill flutes and screw threads in combination.

Although the invention has been shown and described in what is conceived to be the most practical and preferred embodiment, it is recognized that departures may be made therefrom within the scope and spirit of the invention, which is not to be limited to the details disclosed herein but is to be accorded the full scope of the claims so as to embrace any and all equivalent devices and apparatus's.

Having described our invention, what we claim as new and desire to secure by letters patent is:

1. A dent puller attachment tool cooperating with a pneumatic wrench having a forward and reverse drive comprising in combination: an elongated hollow shaft, said shaft having an outside perimeter, said shaft having first and second externally threaded ends, a stop, said stop having a first internally threaded end, said first end of said shaft mating with said first end of said stop, a jam nut, said jam nut having internal threads, a housing, said housing having internal threads, said second end of said shaft mating with said jam nut and said housing, said housing having an inside surface area being of a shape and size to accept and mate with said wrench, an L-shaped locking member, said housing having means to pivotally mount said locking member, said locking member having a first unlocked position and a second locked position, when said locking member assumes its said second position said wrench is secured to said housing, a weight, said weight and said shaft having a slidable relationship, a rod, said rod having an outside perimeter, said rod having a first and second end, said first end of said rod having external threads, a nose cone, said rod being of a sufficient length to extend longitudinally through said shaft and said stop into said nose cone, said nose cone having a first and second end, said first end of said nose cone having internal threads, said first end of said rod mating with said first end of said nose cone, said second end of said nose cone having an internally tapered configuration, a self tapping threaded member to engage a workpeice, said self tapping member having a tapered head, said second end of said nose cone capturing and securing said tapered head, an abutment member, said abutment member having an outside perimeter, said abutment member having a first and second end, means to attach said first end of said abutment to said second end of said rod, said second end of said abutment having means to removably engage said drive of said wrench, said perimeter of said abutment being less than said perimeter of said shaft, said perimeter of said rod being less than said perimeter of said abutment, whereby, when said wrench drive engages said second end of said abutment and said locking member assumes said second position, said abutment, said rod, said nose cone and said self tapping member rotate forward into said workpeice.

2. The tool of claim 1 in which said second end of said abutment having means to removably engage said drive of said wrench is a recess, said recess being of a shape and size to accept engagement with said drive.

3. The tool of claim 2 in which said recess has a sufficient depth to further include a shock absorbing insert.

4. The tool of claim 1 in which said self tapping member to engage a workpeice includes a drill on the distal end opposite said tapered head.

* * * * *